US005724788A

United States Patent [19]

Rommel et al.

[11] Patent Number: 5,724,788

[45] Date of Patent: Mar. 10, 1998

[54] FOUNDRY CORE ASSEMBLING APPARATUS

[75] Inventors: Reiner Rommel, Brühl; Ulf Stangier, Ketsch, both of Germany

[73] Assignee: Adolf Hottinger Maschinenbau GmbH, Mannheim, Germany

[21] Appl. No.: 632,406

[22] PCT Filed: Jul. 14, 1994

[86] PCT No.: PCT/DE94/00808

§ 371 Date: Apr. 15, 1996

§ 102(e) Date: Apr. 15, 1996

[87] PCT Pub. No.: WO95/10374

PCT Pub. Date: Apr. 20, 1995

[30] Foreign Application Priority Data

Oct. 13, 1993 [DE] Germany ..... 43 34 857.2

[51] Int. Cl.[6] ..... B65B 35/54

[52] U.S. Cl. ..... 53/154; 53/122; 53/168; 53/540; 414/788.4; 414/789.6; 414/789.9

[58] Field of Search ..... 53/111 R, 122, 53/154, 155, 168, 540; 156/60, 290, 291; 164/137; 198/363; 414/788.1, 788.4, 789.6, 789.9, 790.2

[56] References Cited

U.S. PATENT DOCUMENTS

| | | | |
|---|---|---|---|
| 3,989,090 | 11/1976 | Kawai | 164/228 |
| 4,190,097 | 2/1980 | Allread et al. | 164/16 X |
| 4,744,853 | 5/1988 | Landua et al. | 164/412 X |
| 5,250,128 | 10/1993 | Landua et al. | 156/290 X |

FOREIGN PATENT DOCUMENTS

| | | |
|---|---|---|
| 0 123 756 | 11/1984 | European Pat. Off. . |
| 0 209 809 | 1/1987 | European Pat. Off. . |
| 0 495 157 | 7/1992 | European Pat. Off. . |
| 36 24 554 | 1/1988 | Germany . |

OTHER PUBLICATIONS

Herbert Knab, "*Automatische Kernherstellung nach dem Maskenformverfahren für Hydraulikgus in einem verketteten System*"; Giesserei 79 (1992) 3 Feb., No. 3 Seite 98–102, no translation.

*Primary Examiner*—Daniel Moon

*Attorney, Agent, or Firm*—Bell Seltzer Intellectual Property Law Group of Alston & Bird LLP

[57] ABSTRACT

An apparatus for assembling foundry cores comprises a conveyor (4) operating between a removal station (1) of a core shooting machine (2) and a transfer station (3), a packing assembly (5) having at least one first manipulator (6) and adhesive applicators (8), and an adjoining dip bath (9), if need be, as well as a subsequent drying oven (10). To automatically and rapidly assemble even complex core packs (20) with the least possible equipment, the apparatus is designed and constructed such that the packing assembly (5) is supplied, the via transfer station (3), with cores (11) from at least two core shooting machines (2), and the first manipulator (6) serves to grip and deposit or stack the cores (11), and that the cores (11) may be placed, one on top of the other, on a carriage (15) or a running gear.

6 Claims, 2 Drawing Sheets

FOUNDRY CORE ASSEMBLING APPARATUS

BACKGROUND OF THE INVENTION

The invention relates to an apparatus for assembling foundry cores to form ready-to-cast core packs. The apparatus comprises a conveying device operating between a removal station of a core shooting machine and a transfer station, a packing assembly having at least one first manipulator and adhesive applicators, and a dip bath, if need be, as well as a subsequent drying oven.

Apparatus of the type described above have been known from practice for years. Only by way of example, reference may be made to DE-PS 35 26 265 and corresponding U.S. Pat. No. 4,744,853. This prior art discloses a core packing machine for a fully automatic assembly of ready-to-cast core packs. In this machine, the cores produced on a core shooting machine are removed therefrom, placed on a pallet, raised therefrom to a core swiveling device, where they are laterally engaged by a clamping device, and provided jointly—in spaced-apart relationship—with adhesive from adhesive applicators. Only thereafter, are the cores moved by lifting devices into a packing assembly and pressed together after retraction of the clamping device.

The apparatus known from DE-PS 35 26 265 is, however, problematic in practice, since it allows to pack only cores produced in a single core shooting machine. In particular, in the case of core packs comprising a very large number of cores or having a very complex structure, it is, however, necessary to produce the individual cores with different tools on different core shooting machines and to assemble same to a core pack. Furthermore, in the known apparatus, the handling of the cores, via the step of applying adhesive, to the pressing is costly and requires a considerable expenditure in apparatus.

It is therefore the object of the present invention to improve and further develop an apparatus for packing cores of the initially described kind, so that it permits a rapid automatic assembly of even complex core packs with the least possible amount of equipment.

SUMMARY OF THE INVENTION

The core assembling apparatus of the present invention accomplishes the foregoing object and comprises a transfer station, and a pair of core shooting machines positioned on opposite sides of the transfer station and so that the core shooting machines define a transverse direction extending therebetween. A pair of pallets are mounted for movement along the transverse direction between respective ones of the core shooting machines and the transfer station, and each pallet is configured for supporting a plurality of side-by-side cores which are aligned in the transverse direction and so that the cores supported on the pair of pallets may be aligned at the transfer station in a side-by-side arrangement extending in the transverse direction. At least one manipulator is provided for grasping the cores while in the side-by-side arrangement at the transfer station and stacking the cores on top of each other, and at least one adhesive applicator is provided for applying adhesive to a surface of at least some of the cores so as to secure together the stacked cores and form an integral core pack. Accordingly, the apparatus of the present invention is designed and constructed such that the packing assembly receives, via the transfer station, cores from at least two core shooting machines. Also, the apparatus of the present invention is designed and constructed such that the one manipulator serves to grasp and deposit or stack the cores, and that the cores may be placed, one on top of the other, on a carriage or running gear.

In accordance with the invention, there are basically two alternatives of an apparatus in accordance with the invention, namely on the one hand with respect to supplying cores from at least two different core shooting machines and, on the other hand, with respect to depositing, or with respect to stacking the cores for purposes of packing.

In accordance with the invention it has thus been recognized that with simple constructional means cores from different core shooting machines may be transported to a single apparatus for packing the cores, namely in that, regardless from which core shooting machine they originate, the cores are transported to the transfer station. This transfer station forms, before the packing assembly, so-to-speak a junction, from which the individual cores are supplied to the packing assembly piece by piece.

With respect to an especially simple and yet reliable transportation of the cores from the removal station of the core shooting machine to the transfer station serving as a junction, it will be especially advantageous, when each core shooting machine is provided with its own removal station and when in this removal station the cores are deposited on a pallet associated to the conveyor. This pallet could be provided with especially rigid holders for receiving the cores. However, this requires an accurate adjustment of the holders, so as to prevent tensions from occurring upon a transfer of the core, and a therefrom resultant destruction of the core. To this extent, it will be quite especially advantageous, when the pallet has for each core an air cushion for depositing the core. This would allow to deposit each core from the upper tool on the air cushion, the air cushions being capable of adapting themselves approximately to the position of the cores "suspending" from the upper tool. In other words, the air cushion could quasi float toward the cores still "suspending" from the upper tool before they are removed, thereby making a special adjustment unnecessary. Thus, damage to the cores is largely eliminated. Only when the cores rest on the air cushion, would they be pushed off or ejected from the upper tool. A distortion is eliminated as a result of the quasi "floating" air cushions.

In a further advantageous manner, and in particular for verifying the cores to be packed, it will be especially advantageous, when two core shooting machines are provided each with one removal station. The pallets loaded with cores in the removal station could, for example, be supplied from both sides to the transfer station, and be positioned therein approximately side by side. The packing assembly would then be able to help itself from both conveyor pallets.

As regards a reliable transfer of the cores in the transfer station, it will be of further advantage, when the conveyor pallets can be moved, if need be on a carriage, below the first manipulator, or when the manipulator can be moved above the conveyor pallets. From there, and in particular within the scope of the alternative likewise claimed to be material to the invention, the cores can be grasped by the first manipulator and be deposited or stacked for packing, while covering the shortest distances. More specifically, the cores are deposited to this end, one on top of the other, on a carriage or running gear, the sequence of the cores to be grasped and deposited being predeterminable as desired via a corresponding control system.

As regards an effective joining of the cores to be packed, it will be quite especially advantageous, when the cores are glued together at least partially by means of an adhesive. To this end, before, during, or after the handling by the first manipulator, applicators could apply the adhesive to the surfaces of the cores that are intended to abut each other. More specifically, adhesive could be applied to the upper surface of a first or lowest core. A second core is then pressed or placed thereon with its upper surface having received likewise a coat of adhesive. After stacking the individual cores in accordance with the foregoing description, the pack could be pressed one more time in a single axial direction, so that the adhesive between the cores is fully pushed into the pores thereof. However, the pressing step could occur already while the cores are being stacked, so that no further handling for the pressing is needed.

In a next step, the now stacked and glued cores are rotated by means of the first manipulator or by means of a subsequent swiveling device, preferably by 90°. As a result, the core are brought from their stacked position to a position in successive or side-by-side relationship. The first manipulator, having been previously referred to several times, could be provided with grippers or clamping jaws that engage on both sides for handling the cores, it being necessary to adjust the contact pressures required for the gripping or clamping to the weak strength of the cores. The same would apply to the swiveling device, which could be likewise provided with grippers or clamping jaws engaging on both sides of the cores.

After the cores or the core pack produced in accordance with the foregoing description have been deposited, rotated by 90°, on a carriage or running gear, a second manipulator is used to receive the rotated core pack and to deliver it to a subsequent dip or blacking bath. In this bath, the surface region of the core pack is coated or impregnated, so as to avoid that during the casting molten iron burns into the core sand. In other words, the surface of the core pack is improved by this step. Likewise, the second manipulator could be provided for engagement of the cores on both sides with grippers or clamping jaws, to which the same adjustment applies as described above with respect to the first manipulator.

Finally, the second manipulator could also be used for transferring the core pack removed from the dip bath to a drying oven. In a further advantageous manner, and in particular to compensate for the quite considerable transit times, two core packs could be supplied at the same time parallel, i.e., side by side, to this drying oven. For this purpose, any kind of oven may be used, in particular, belt conveyor ovens or gravity discharge ovens.

There exist various possibilities of improving and further developing the teaching of the present invention in advantageous manner. To this end, reference may be made to the following description of two embodiments of the invention with reference to the drawing. In conjunction with the description of the preferred embodiments of the invention with reference to the drawing, also generally preferred embodiments and further developments of the teaching are described.

BRIEF DESCRIPTION OF THE DRAWINGS

Some of the objects and advantages of the invention having been stated, others will appear as the description proceeds, when considered in conjunction with the accompanying drawings, in which.

DETAILED DESCRIPTION OF THE PREFERRED EMBODIMENTS

Figure 1:
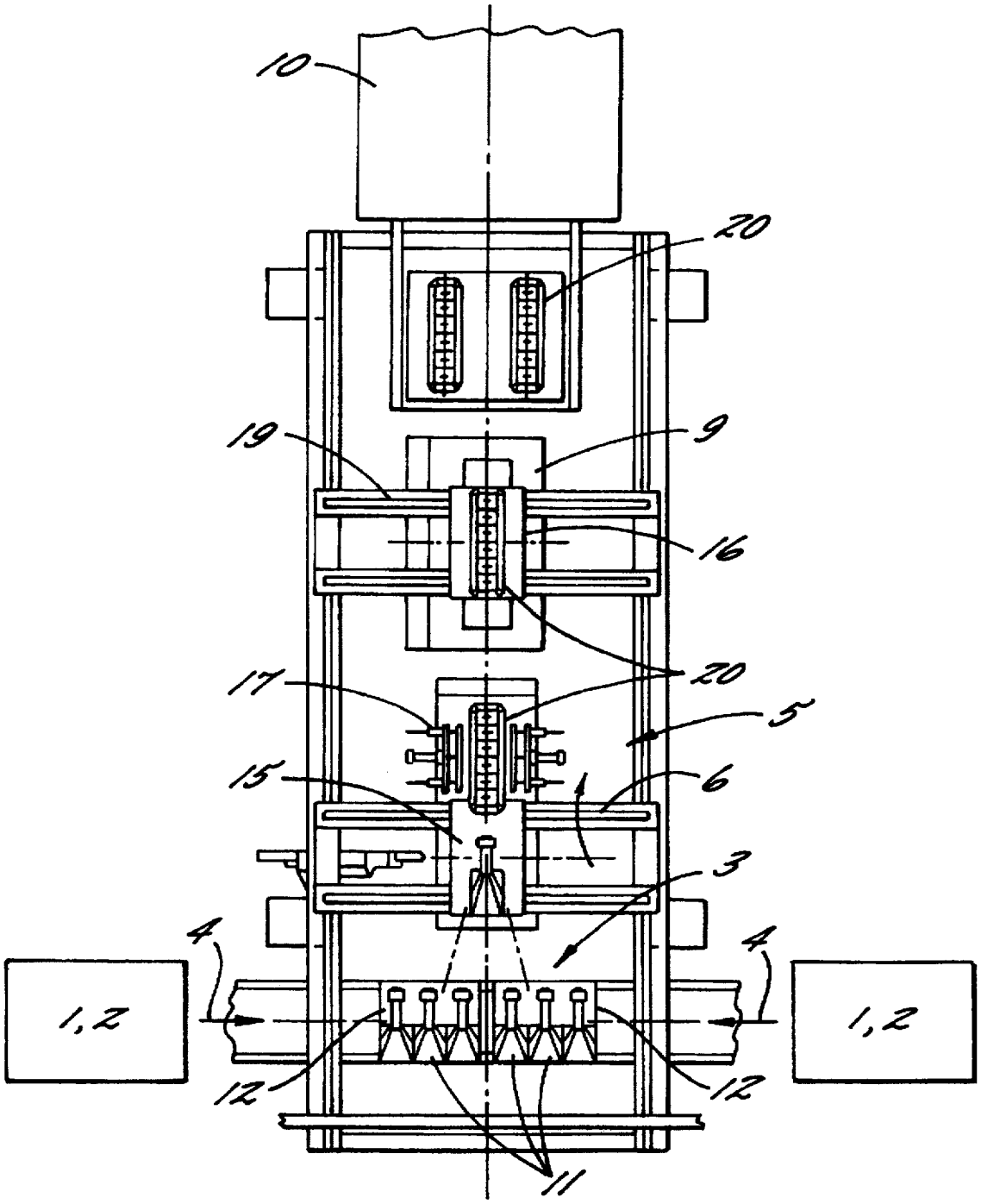
FIG. 1 is a schematic top view of a first embodiment of a core packing apparatus in accordance with the invention, with two core shooting machines each supplying three cores.
Figure 2:
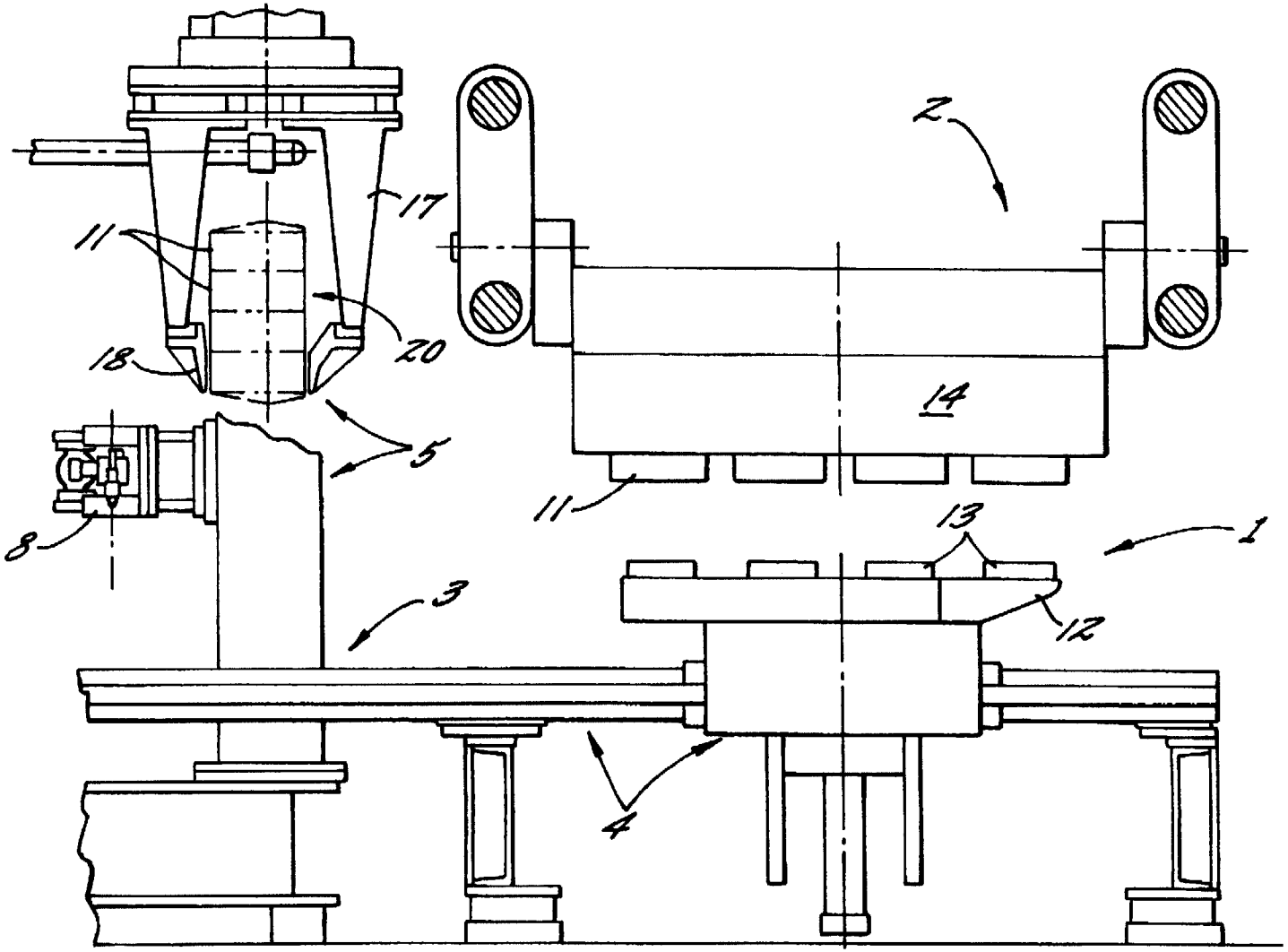
FIG. 2 is a schematic side view, in part, of a second embodiment of an apparatus in accordance with the invention, with four cores being removed from a core shooting machine.

Shown in FIGS. 1 and 2 are slightly modified apparatus for packing cores with a conveyor 4 operating between a removal station 1 of a core shooting machine 2, and a transfer station 3, as well as a packing assembly 5.

As shown in FIG. 1, the packing assembly 5 includes two manipulators 6, and adhesive applicators 8. Arranged subsequent or adjacent thereto are a dip bath 9 as well as a drying oven 10.

In accordance with the invention, the packing assembly 5 is adapted to receive cores 11 from two core shooting machines, as may be noted in particular from FIG. 1. In the selected embodiment of FIG. 1, each core shooting machine 2 supplies a total of three cores 11.

As shown in FIG. 2, each core shooting machine 2 is associated with one removal station 1, the cores 11 being deposited in removal station 1 on a pallet 12 associated to conveyor 4. In the selected embodiment of FIG. 2, the core shooting machine 2 delivers a total of four cores 11, the number of cores 11 that can be produced simultaneously with one set of tools being dependent on the geometry or space requirements.

As best seen in FIG. 2, the pallet 12 is provided with an air cushion 13 serving as a bearing surface for each core 11. The cores 11 are deposited by an upper tool 14, only schematically shown in FIG. 2, on the air cushions 13. Same adapt themselves approximately to the position of the cores suspending from the upper tool 14, when cores are transferred or removed.

As again shown in FIG. 1, the pallets 12 are adapted for movement on both sides to the transfer station 3 and for positioning approximately side by side in the transfer station 3. Due to the displaceability of the first manipulator 6, same can be moved over or above the pallets 12, and serves to grip and deposit or stack the cores 11 on a carriage 15. On carriage 15, the cores 11 are placed on top of each other or stacked, with adhesive applicators 8, only schematically shown in FIG. 1, serving to apply a partial coating of adhesive and to cause certain surfaces of the cores to abut each other. The adhesive is applied selectively before, during, or after the handling by the first manipulator 6.

Furthermore, the first manipulator is followed by a special swiveling device 17, which is used to rotate the stacked or glued cores preferably by 90°. Both the first manipulator 6 and the swiveling device 17 are provided with clamping jaws 18 engaging the cores on both sides, so as to grasp the cores 11 or a core pack 20.

A second manipulator 19 serves to receive the rotated core pack 20 and to deliver same to a dip bath 9. At this point, it would be possible to place the core pack 20 on a lifting mechanism and to lower it on a corresponding load surface 16 into the dip bath 9.

From dip bath 9, the core pack 20 is removed again by manipulator 19, which may, moreover, be provided likewise with grippers of clamping jaws 18 engaging the cores 11 on both sides, and which grasps or clamps the core pack 20 in the usual manner. Finally, the second manipulator 19 serves to deliver the core pack 20 to the drying oven 10, which can receive simultaneously two core packs 20 positioned side by side.

Finally, it should explicitly be noted that the foregoing embodiments have been described to explain the claimed teaching only by way of example, without however limiting same thereto.

We claim:

1. An apparatus for assembling foundry cores to form ready-to-cast core packs, and comprising a transfer station, a pair of core shooting machines positioned on opposite sides of the transfer station and so that the core shooting machines define a transverse direction extending therebetween, a pair of pallets mounted for movement along the transverse direction between respective ones of the core shooting machines and the transfer station, with each pallet being configured for supporting a plurality of side-by-side cores which are aligned in the transverse direction and so that the cores supported on the pair of pallets may be aligned at the transfer station in a side-by-side arrangement extending in the transverse direction, at least one manipulator for grasping the cores while in the side-by-side arrangement at the transfer station and stacking the cores on top of each other, and at least one adhesive applicator for applying adhesive to a surface of at least some of the cores so as to secure together the stacked cores and form an integral core pack.

2. The apparatus as defined in claim 1 further comprising a dip bath and a drying oven disposed in alignment with said transfer station along a direction perpendicular to said transverse direction, and means for conveying the integral core pack into said dip bath and then into said drying oven.

3. The apparatus as defined in claim 2 wherein the conveying means includes means for rotating the integral core pack 90° about a horizontal axis.

4. The apparatus as defined in claim 1 wherein each pallet includes an air cushion for supporting each of the cores thereon.

5. The apparatus as defined in claim 1 wherein each pallet is moveable along said transverse direction so that each core may be moved to a position directly below said one manipulator.

6. The apparatus as defined in claim 1 wherein the manipulator is mounted for movement along the transverse direction so as to be able to separately grasp and stack the cores while they are in said side-by-side arrangement at the transfer station.

* * * * *